US006537062B1

(12) United States Patent
Wong et al.

(10) Patent No.: US 6,537,062 B1
(45) Date of Patent: Mar. 25, 2003

(54) WINDPROOF LIGHTER WITH FLINT-TYPE IGNITION SYSTEM

(76) Inventors: Chi Lam Wong, 1617 S. Euclid Ave., San Gabriel, CA (US) 91776; Lian Wang, 143 Qu Fu West Road, Shanghai (CN)

( * ) Notice: Subject to any disclaimer, the term of this patent is extended or adjusted under 35 U.S.C. 154(b) by 0 days.

(21) Appl. No.: 10/174,752

(22) Filed: Jun. 20, 2002

(30) Foreign Application Priority Data

Nov. 10, 2001 (CN) ..... 01254775

(51) Int. Cl.[7] ..... F23Q 9/00; F23Q 9/08; F23Q 2/08

(52) U.S. Cl. ..... 431/278; 431/280; 431/133

(58) Field of Search ..... 431/278, 280, 431/281, 285, 277, 127, 133, 129, 344, 255, 153

(56) References Cited

U.S. PATENT DOCUMENTS 5,055,033 A * 10/1991 Lee ..... 431/255

2002/0123017 A1 * 9/2002 Xu ..... 431/153

FOREIGN PATENT DOCUMENTS

GB 2 259 755 A * 3/1993

* cited by examiner

*Primary Examiner*—Henry Bennett
*Assistant Examiner*—Alfred Basichas
(74) *Attorney, Agent, or Firm*—Raymond Y. Chan; David and Raymond Patent Group

(57) ABSTRACT

A windproof lighter includes a gas directing arrangement including a torch nozzle, a gas nozzle, and a gas directing unit including a torch directing conduit and a gas directing conduit for directing a flow of gas toward the torch nozzle and the gas nozzle respectively. A gas detouring unit is movably mounted to the casing to block up the flow of gas passing through the gas directing conduit while the torch directing conduit is remained open. An ignition system installed into the casing for producing sparks directed toward the gas nozzle to ignite the gas emitted from the gas nozzle to provide a visible flame, so as to ignite the gas emitted from the torch nozzle to provide a torch flame. Therefore, the lighter is capable of providing the torch and visible flames at the same time and providing only the torch flame while operating the gas detouring unit.

20 Claims, 9 Drawing Sheets

WINDPROOF LIGHTER WITH FLINT-TYPE IGNITION SYSTEM

BACKGROUND OF THE PRESENT INVENTION

1. Field of Invention

The present invention relates to a lighter, and more particularly to a windproof lighter incorporated with a flint-type ignition system to ignite the lighter to selectively provide a torch flame and a visible frame.

2. Description of Related Arts

Lighters have been known and sold through the world. A conventional lighter comprises a single gas emitting nozzle for producing either a torch flame or a visible flame. It is known that a visible flame type lighter, such as a conventional cigarette lighter, comprises a flint ignition system and provides a general temperature visible flame that fits for lighting up a cigarette or a cigar. However, it is difficult to ignite the lighter in a windy environment wherein the wind may blow off the visible flame immediately.

The torch flame type lighter comprises a torch nozzle, having a plurality of meshes, adapted for violently releasing the emitting gas so as to provide a windproof feature of the lighter. Since the torch flame is stronger and hotter than the visible flame, the torch flame is capable of easily lighting up a smoking material such as cigar. Since the cigar has a bigger diameter and the cigar tobacco is dryer and harder, the torch lighter that can produce a stronger and hotter torch flame is generally used to ignite the cigars.

Due to the structure of the torch nozzle, the torch nozzle must have a micro nozzle pore, having a diameter approximately from 0.05 mm to 0.12 mm, to pressurize the emitting gas so as to provide a stronger torch flame. Such torch flame type lighter must be incorporated with a piezoelectric unit because the micro nozzle pore of the torch nozzle may easily get stuck by the residue of the flint after ignition.

Conversely, the piezoelectric unit has a several drawbacks. The piezoelectric unit can only produce a single spark through an ignition tip directly toward the torch nozzle in order to ignite the emitting gas therefrom such that the spark always fail to ignite the emitting gas from the torch nozzle. In other words, the piezoelectric unit is not reliable for igniting the lighter. Comparing with a visible-type lighter, the flint can produces sparks in a spreading manner. In other words, the visible-type lighter is advantage in practical use.

Thus, due to the piezoelectricity production, the service life span of the piezoelectric unit is shorter than that of the flint ignition system. Once the piezoelectricity is used up, the lighter must be disposed. However, the flint is replaceable such that the user can re-use the visible-type lighter. Accordingly, a need will be seen for a lighter incorporated with the flint ignition system in order to provide a windproof torch flame.

Besides, smokers always have a conflict to choose the visible flame type lighter in order to keep the taste of the cigarette or the torch flame type lighter for conveniently. Pipe smokers will more concern the flame to light up the high quality of tobacco.

SUMMARY OF THE PRESENT INVENTION

A main object of the present invention is to provide a windproof lighter with a flint-type ignition system, wherein the windproof lighter is adapted to produce both torch flame and visible flame.

Another object of the present invention is to provide a windproof lighter with a flint-type ignition system which comprises a flint and a striker wheel to produce a spark for igniting the emitting gas, so as to enhance the ignition of the windproof lighter.

Another object of the present invention is to provide a windproof lighter with a flint-type ignition system, which comprises a gas detouring button for directing a flow of the emitting gas to the torch nozzle and the gas nozzle, such that the windproof lighter is adapted to provide the torch flame from the torch nozzle and the visible flame from the gas nozzle individually or at the same time.

Another object of the present invention is to provide a windproof lighter with a flint-type ignition system, wherein the emitting gas released from a torch nozzle of the windproof lighter is ignited by the visible flame, so as to prevent the meshes of the torch flame being stuck by the residues of the flint when the striker wheel strikes against the flint. In other words, the flint-type ignition system does not affect the ignition operation of the windproof lighter of the present invention to provide the torch flame.

Another object of the present invention is to provide a windproof lighter with a flint-type ignition system, which does not significantly alter the original structural design of the lighter, so as to minimize the manufacturing cost of the present invention.

Accordingly, in order to accomplish the above objects, the present invention provides a windproof lighter, comprising:

a supporting frame comprising a casing having a liquefied gas storage;

a gas directing arrangement comprising a gas releasable valve extended from the liquefied gas storage for controlling a flow of gas from the liquefied gas storage, a torch nozzle appearing from the ceiling of the casing, a gas nozzle positioned adjacent to the torch nozzle, and a gas directing unit comprising a torch directing conduit extended from the gas releasable valve to the torch nozzle for directing the flow of gas toward the torch nozzle and a gas directing conduit extended from the gas releasable valve to the gas nozzle for directing the flow of gas toward the gas nozzle; and an ignition system, comprising:

a flint supported by the casing; and a striker wheel having a circumferential coarse striking surface positioned in contact with the flint, wherein the flint is retained urging against the striking surface of the striker wheel for producing sparks directed toward the gas nozzle when the striking surface is driven to strike against the flint, such that the gas emitted from the gas nozzle is ignited to provide a visible flame, wherein the visible flame functions as a flame igniter to ignite the gas emitted from the torch nozzle to provide a torch flame at the same time.

DETAILED DESCRIPTION OF THE PREFERRED EMBODIMENT

Figure 1:
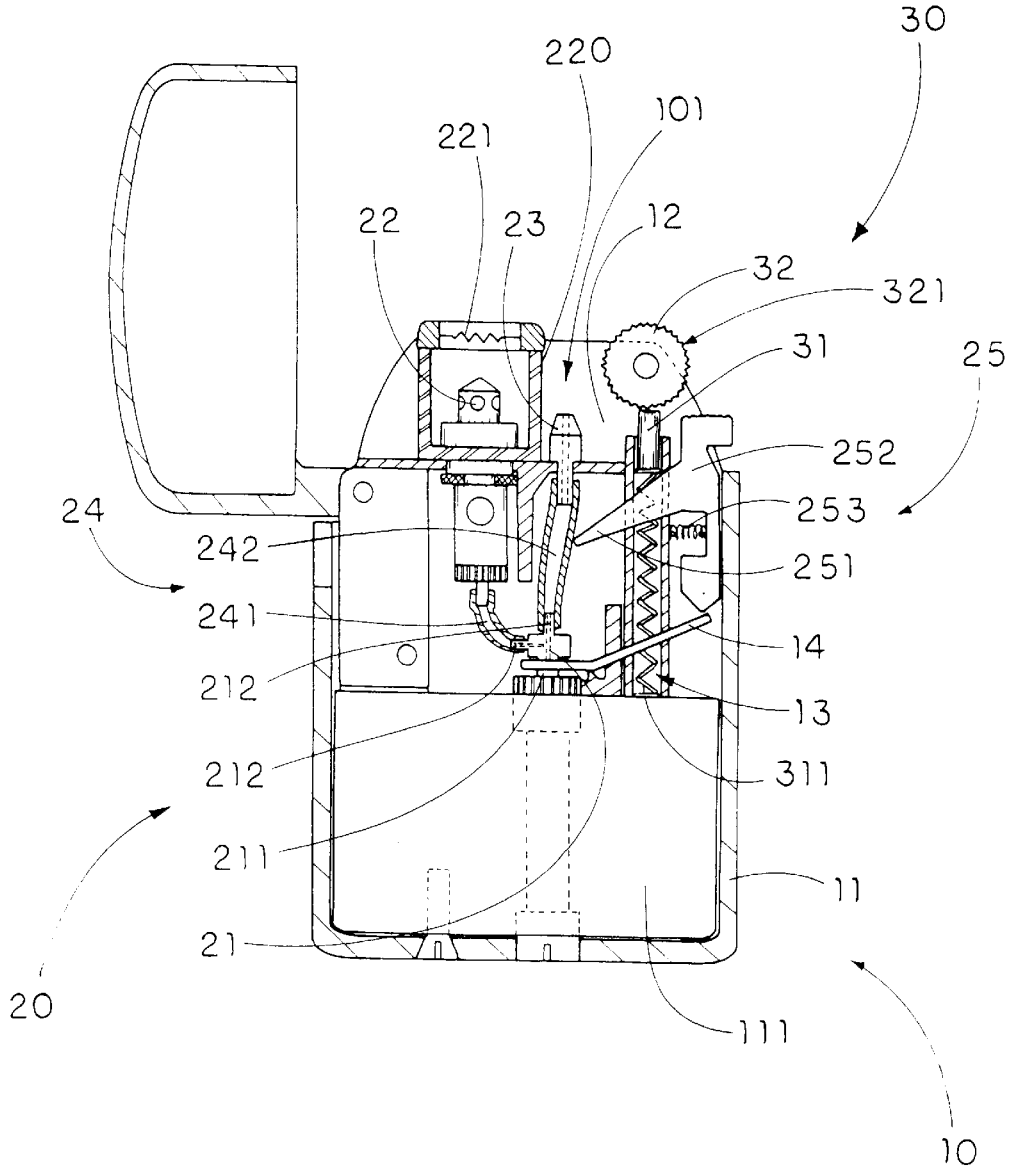
FIG. 1 is a sectional view of a windproof lighter with a flint-type ignition system according to a first preferred embodiment of the present invention.

Referring to FIG. 1 of the drawings, a windproof lighter according to a preferred embodiment of the present invention is illustrated, wherein the windproof lighter comprises a supporting frame 10 comprising a casing 11 having a liquefied gas storage 111, a gas directing arrangement 20 communicating with the liquefied gas storage 111, and an ignition system 30.

The gas directing arrangement 20 comprises a gas releasable valve 21 extended from the liquefied gas storage 111 for controlling a flow of gas from the liquefied gas storage 111, a torch nozzle 22 receiving in a nozzle housing 220 and appearing from the ceiling of the casing 11, a gas nozzle 23 positioned adjacent to the torch nozzle 22, and a gas directing unit 24 comprising a torch directing conduit 241 extended from the gas releasable valve 21 to the torch nozzle 22 for directing the flow of gas toward the torch nozzle 22 and a gas directing conduit 242 extended from the gas releasable valve 21 to the gas nozzle 23 for directing the flow of gas toward the gas nozzle 23.

The ignition system 30 comprises a flint 31 supported by the casing 11 and a striker wheel 32 having a circumferential coarse striking surface 321 positioned in contact with the flint 31.

The flint 31 is retained urging against the striking surface 321 of the striker wheel 32 for producing sparks directed toward the gas nozzle 23 when the striking surface 321 is driven to strike against the flint 31, such that the gas emitted from the gas nozzle 23 is ignited to provide a visible flame, so as to ignite the gas emitted from the torch nozzle 22 to provide a windproof torch flame at the same time.

According to the preferred embodiment, the supporting frame 10 further has a pair of supporting walls 12 protruded on opposite sides of a ceiling of the casing 11, and an ignition cavity 101 provided between the two supporting walls 12 wherein a flint housing 13 is provided on the ceiling of the casing 11 within the ignition cavity 101.

The supporting frame 10 further comprises a lever arm 14 pivotally supported in the casing 11 wherein the lever arm 14 has a lifting end engaged with the gas releasable valve 21 and a depressible end arranged in such a manner that when the depressible end of the lever arm 14 is depressed downwardly, the lifting end of the lever arm 14 is pivotally lifted up the gas releasable valve 21 so as to release the gas in the liquefied gas storage 111.

The flint 31 is supported by a flint-spring 311 wherein the flint 31 and the flint-spring 311 are received in the flint housing 13. The striker wheel 32 is rotatably supported between the two supporting walls 12 wherein the flint 31 is retained urging against the striking surface 321 of the striker wheel 32 by means of the flint-spring 311 for producing the sparks directed toward the gas nozzle 23 when the striker wheel 32 is rotatably driven to strike against the flint 31.

According to the preferred embodiment, the gas nozzle 23 is positioned between the torch nozzle 22 and the flint 31 in such a manner that when the striker wheel 32 strikes against the flint 31 to produce the sparks, the sparks will ignite the flow of gas released from the gas nozzle 23 to provide the visible flame. Then, due to the heat of the visible flame, the visible flame will ignite the flow of gas released from the torch nozzle 22 to provide the windproof torch flame. Accordingly, the gas nozzle 23 is upwardly extended to a position at least 2mm below a ceiling of the nozzle housing 220 of the torch nozzle 22 to prevent the residue of the flint 31 spit towards the torch nozzle 22 when the striker wheel 32 strike against the flint 31.

Moreover, the torch nozzle 22 is surrounded by the nozzle housing 220 within the ignition cavity 101 such that when the striker wheel 32 is stroked against the flint 31 the residue of the flint 31 cannot be entered into the torch nozzle 22 and the torch directing conduit 241 as well. In other words, since the torch nozzle 22 is positioned with a predetermined distance away from the flint 31, the residue of the flint 31 will not be stuck on the micro nozzle pore of the torch nozzle 22 after ignition, so as to prevent the failure in ignition of the windproof lighter.

Figure 2A:
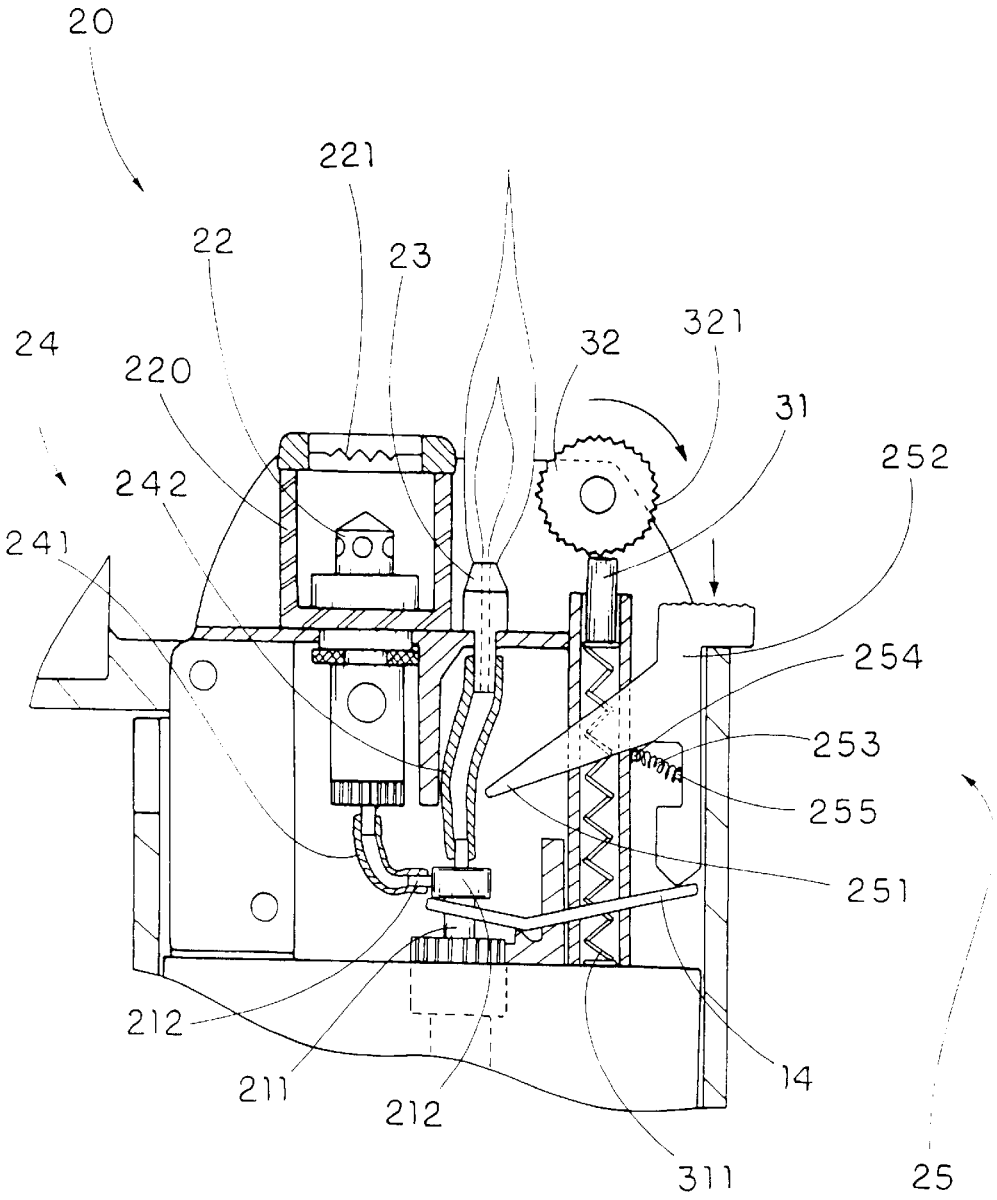
FIG. 2A is a partially sectional view of the windproof lighter with the flint-type ignition system according to the above first preferred embodiment of the present invention, illustrating the windproof lighter being ignited to selectively provide both torch flame and visible flame.
Figure 2B:
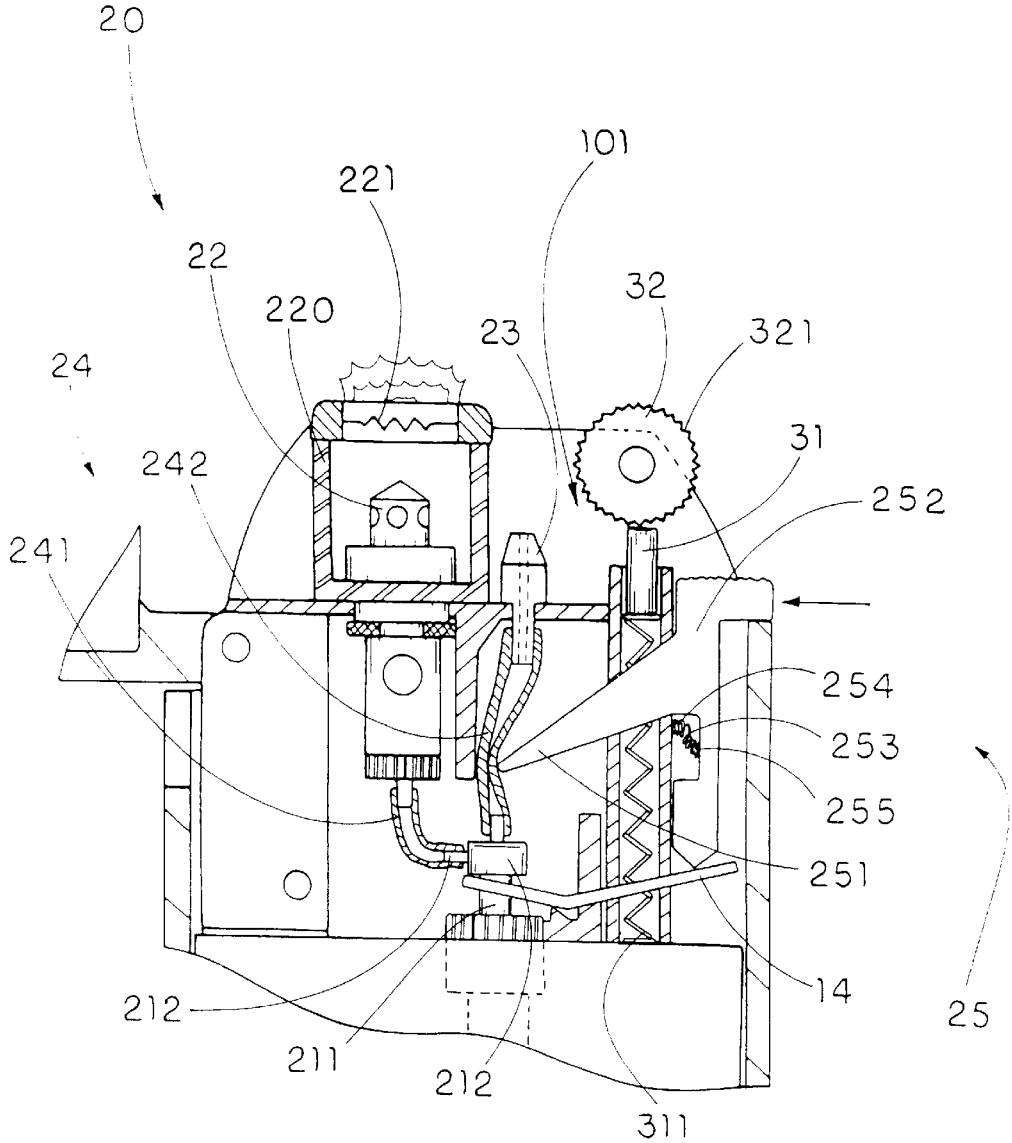
FIG. 2B is a partially section view of the windproof lighter with the flint-type ignition system according to the above first preferred embodiment of the present invention, illustrating the windproof lighter being ignited to provide the torch flame only.

As shown in FIGS. 1, 2A and 2B, the torch nozzle 22 comprises a re-ignition element 221 provided on the ceiling of the nozzle housing 220 at a position above the torch nozzle 22 wherein when the torch nozzle 22 is ignited, the re-ignition element 221 is heated up and maintained at a predetermined temperature adequate to re-ignite the emitting gas passing through the torch nozzle 22, so that the torch nozzle 22 is capable of providing a windproof torch flame for the windproof lighter.

The gas releasable valve 21 has a gas inlet 211 communicating with the liquefied gas storage 111 and two gas outlets 212 sealedly coupling with the torch directing conduit 241 and the gas directing conduit 242 respectively in such a manner that the flow of gas from the liquefied gas storage 111 is arranged to split into two portions by the gas releasable valve 21 directly toward to the torch nozzle 22 and the gas nozzle 23 respectively.

The gas directing arrangement 20 further comprises a gas detouring unit 25 mounted to the casing 11 in a movable manner to close the gas directing conduit 242 while the torch directing conduit 241 is remained open. As shown in FIGS. 1 and 2, the gas detouring unit 25 comprises a pusher arm 251 movably supported in the casing 11 and an operation button 252 extended from the casing 11 to outside wherein the pusher arm 251 is arranged to be driven by the operation button 252 to bias against the gas directing conduit 242, so as to block up the flow of gas passing therethrough.

As shown in FIG. 1, the operation button 252 is integrally extended from the pusher arm 251 and extended into the casing 11 at a position that a bottom portion of the operation button 252 is biased against the depressible end of the lever arm 14 in such a manner that when the operation button 252 is depressed downwardly, the depressible end of the lever arm 14 is driven downwardly to pivotally lift up the lifting end thereof for releasing gas.

Accordingly, the gas directing conduit 242 is made of elastic material, such as plastic or rubber, such that when the pusher arm 251 is pressed against the gas directing conduit 242, the gas directing conduit 242 is capable of deforming its shape to block the flow of gas passing therethrough. Moreover, the gas directing conduit 242 is capable of deforming back to its original form after the pusher arm 251 is moved away from the gas directing conduit 242 so as to allow the flow of gas passing from the gas releasable valve 21 to the gas nozzle 23. It is worth to mention that the operation button 252 is extended to outside of the casing 11 and is positioned underneath the striker wheel 32 in such a manner that the user is able to operate the pusher arm 251 by inwardly pressing the operation button 252 right below the striker wheel 32 after igniting the windproof lighter.

The gas detouring member 25 further comprises a resilient element 253 which is disposed in the casing 11 for applying an urging pressure against the pusher arm 251 so as to normally retain the pusher arm 251 at a position that the gas directing conduit 242 is adapted for the flow of gas passing therethrough.

The resilient element 253, according to the preferred embodiment, is a compression spring disposed in the casing 11 and is provided between the operation button 252 and an inner wall of the casing 11. The resilient element 253 has two ends biasing against the operation button 252 and the flint housing 13, i.e. the inner wall of the casing 11. Accordingly, the resilient element 253 will normally urge and retain the pusher arm 251 in a position that a pushing end of the pusher arm 251, having a tapered shaped, is moved away from the gas directing conduit 242 in such a manner that the flow of gas released from the gas releasable valve 21 is adapted for passing through the gas directing conduit 242 to the gas nozzle 23.

When an inward force is applied on the operation button 252, the pusher arm 251 is driven to a position that the pushing end of the pusher arm 251 is pressed against the gas directing conduit 242 so as to block up the flow of gas passing therethrough. As shown in FIG. 2B, the gas directing conduit 242 is wedged between the pushing end of the pusher arm 251 and a blocking wall provided in the casing 11, so that no gas is allowed to pass through the gas directing conduit 242.

While releasing the inward force on the operation button 252, the resilient element 253 will rebound to its original form, which pushes the pusher arm 251 back to the original position that the gas directing conduit 242 is adapted for the flow of gas passing therethrough. Therefore, the user is able to select the visible flame and the torch flame by simply operating the gas detouring unit 25.

In order to hold the resilient element 253 in position, the gas detouring unit 25 further comprises a first holding member 254 protruded from the inner wall of the casing 11 and a second holding member 255 protruded from the operation button 252, wherein the first holding member 254 and the second holding member 255 are adapted for engaging with the two ends of the resilient element 253 respectively, so as to secure the two ends of the resilient element 253 to bias against the casing 11 and the operation button 252 respectively to push the pusher arm 251 away from the gas directing conduit 242. Accordingly, the first and second holding members 254, 255, each having a rod-like shape, are adapted for inserting into the two ends of the resilient element 253 at its two ends thereof respectively.

Referring to FIG. 2A, in order to ignite the windproof lighter, the user must apply a rotational force on the striker wheel 32 in such a manner that the striking surface 321 of the striker wheel 32 will strike against the flint 31 for producing sparks toward the gas nozzle 23. At the same time, a downward force must be applied on the operation button 252 to depress the depressible end of the lever arm 14 for releasing gas. Therefore, the flow of gas released from the gas releasable valve 21 through the gas nozzle 23 is ignited by the sparks to provide the visible flame. At the mean time, the visible flame function as a flame igniter to ignite the flow of gas released from the torch nozzle 22 for providing the torch flame. It is worth to mention that since the flow of gas from the gas releasable valve 21 is divided into two portions, the intensity of the torch flame is relatively weak. However, when the user inwardly press against the operation button 252 to drive the pusher arm 251 pressing against the gas directing nozzle 242 so as to block up the flow of gas passing therethrough, the flow of gas from the gas releasing valve 21 will totally pass to the torch directing nozzle 241, so that the intensity of the torch flame will be stronger, as shown in FIG. 2B.

While releasing the downward force on the operation button 252, the lever arm 14 will pivotally move to its position in such a manner that the operation button 252 is moved upwardly by the lifting up movement of the depressible end of the lever arm 14. In other words, the operation button 252 is moved back to its original position after every ignition.

Figure 3:
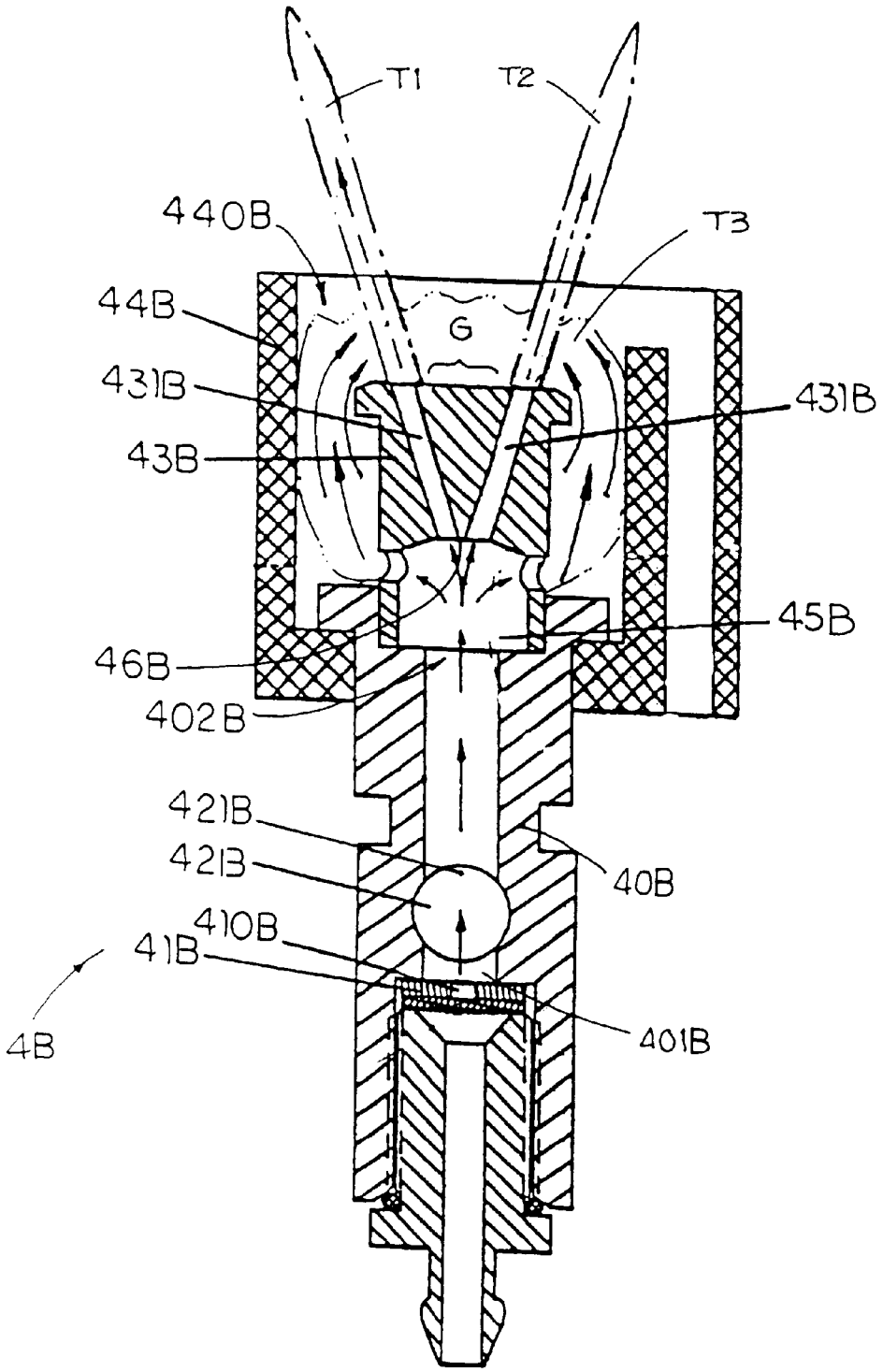
FIG. 3 illustrates an alternative mode of a torch nozzle of the windproof lighter with the flint-type ignition system according to the above first preferred embodiment of the present invention.

FIG. 3 illustrates an alternative mode of the torch nozzle 22B which is adapted to provide two or more torch flames. The torch nozzle 22B comprises a fuel nozzle assembly 4B provided for vaporizing the gas released from the gas releasable valve 21 to a high-pressured gaseous fuel to emit to an ignition chamber 440B.

The torch nozzle 22B further comprises a vaporizer assembly comprising a tubular nozzle body 40B, a nozzle member 41B, a torch head 43B, and a combustion housing 44B.

The tubular nozzle body 40B has a root opening 401B at one end thereof, an emitting opening 402B at another end thereof, at least an air inlet 421B provided adjacent to the root opening 401B, and an elongated mixing chamber 42B axially extended between the air inlet 421B to the emitting opening 402B thereof, wherein a flow of air is capable of inletting into the mixing chamber 42B through the air inlet 421B.

The nozzle member 41B is coaxially connected between the root opening 401B of the nozzle body 40B and the gas releasable valve 21 via the torch directing conduit 241, wherein the torch member 41B has a micro nozzle pore 410B having a diameter as small as 0.05 mm to 0.12 mm, preferable 0.08 mm, wherein the gas released from the gas releasable valve 21 is vaporized into a strong, pressurized gaseous fuel jetting into the mixing chamber 42B. The jetting gaseous fuel provides a suction force to absorb the air into the mixing chamber 42B in such a manner that the mixing chamber 42B has a predetermined length and size arranged for the air and the gaseous fuel being evenly mixed to form a mixture gas at the emitting end 402B of the nozzle body 40B.

The combustion housing 44B is mounted at the emitting end 402B of the nozzle body 40B to define the ignition chamber 440B therein.

The torch head 43B is provided at the emitting end 402B of the nozzle body 40B and supported within the combustion housing 44B in such a manner that the ignition chamber 440B is formed surrounding the torch head 43B.

The torch head 43B has a root chamber 45B having a size larger than the size of the emitting opening 402B of the nozzle body 40B to form a gas stabilizing reservoir to ensure a collective and stable flow of the mixture gas.

The torch head 43B further has at least two elongated nozzle ducts 431B, each having an ignition end and a root end extended to a ceiling of the root chamber 45B, wherein the root ends of the two nozzle ducts 431B are adjacently positioned to define a diversion joint edge 46B therebetween while the ignition ends of the two nozzle ducts 431B are diverged and extended in the ignition chamber 440B to define a torch gap G therebetween. The mixture gas ejected from the two ignition ends is ignited in the ignition chamber 440B to form two torch flames soaring away from the two ignition ends of the two nozzle ducts 431B.

The torch head 43B further comprises means for forming a stable environment root flame T3 around the torch head 43B and the emitting ends 402B of the nozzle ducts 431B adapted for igniting the beams of mixture gas ejected from the nozzle ducts 431B to form two torches T1, T2 soaring away from the ignition ends of the nozzle ducts 431B and holding firm to the soaring torches T1, T2.

Figure 4:
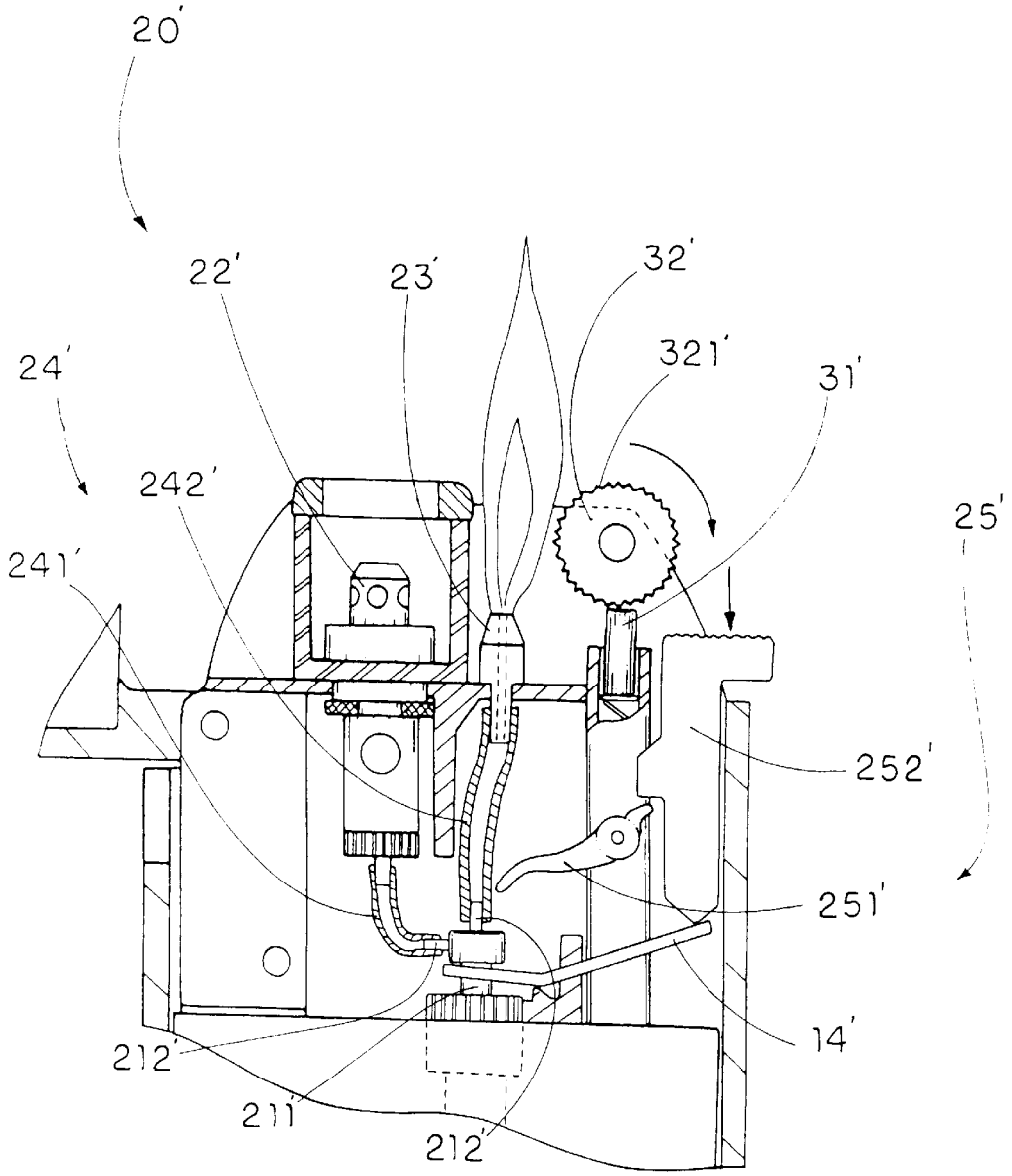
FIG. 4 illustrates an alternative mode of a gas detouring unit of the windproof lighter with the flint-type ignition system according to the above first preferred embodiment of the present invention, illustrating the windproof lighter being ignited to provide visible flame.

FIG. 4 illustrates an alternative mode of the gas detouring unit 25' of the gas directing arrangement 20' for releasing and detouring the flow of gas from the gas releasable valve 21' with a single directional motion. The operation button 252', which is disposed in the casing 11' in a vertical movable manner, has a bottom end extended to bias against the depressible end of the lever arm 14', a control portion extended from the casing 11' to outside, and a shoulder portion provided between the control portion and the bottom end, wherein the operation button 252' is arranged to press downwardly to depress the depressible end of the lever arm 14' for releasing gas from the releasable valve 21'.

The pusher arm 251 ' is pivotally supported in the casing 11' wherein the pusher arm 251' has a pushing end having a tapered shaped and a driving end arranged to be downwardly driven by the shoulder portion of the operation button 252' to pivotally lift up the pushing end to press against the gas directing conduit 242' so as to block up the flow of gas passing through the gas directing conduit 242'.

Figure 5:
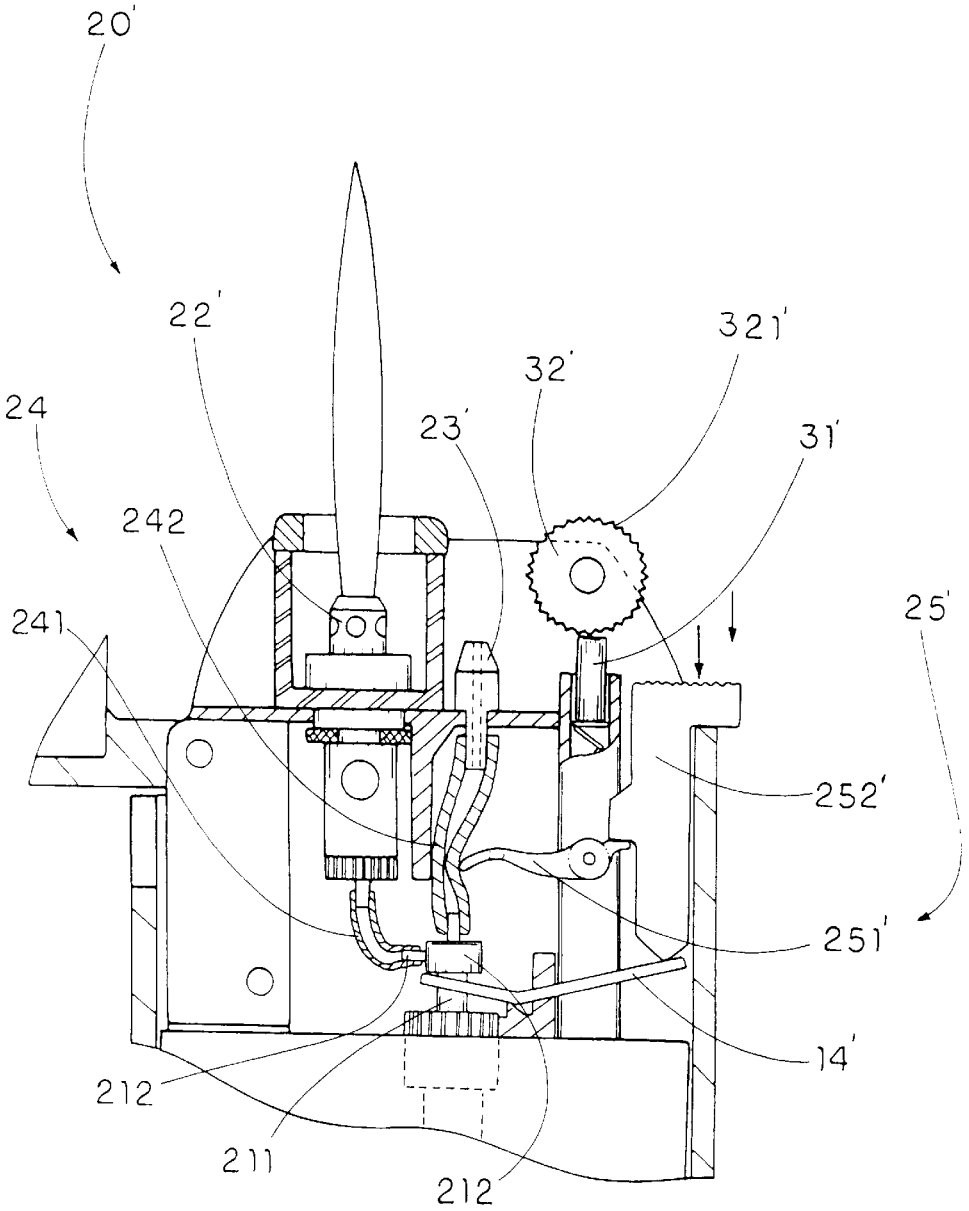
FIG. 5 illustrates the alternative mode of the gas detouring unit of the windproof lighter with the flint-type ignition system according to the above first preferred embodiment of the present invention, illustrating the windproof lighter being ignited to provide the torch flame only.

Furthermore, the torch nozzle 22', according to the embodiment, is arranged to provide a torch flame that is stronger than the visible frame produced by the gas nozzle 23', as shown in FIG. 5.

As shown in FIG. 4, when a downward force is applied on the control portion of the operation button 252', the bottom end thereof presses the depressible end of the lever arm 14' for releasing gas, so that the flow of gas from the gas releasable valve 21' is split to the torch directing conduit 241' and the gas directing conduit 242' for providing the torch flame and the visible flame respectively. The operation button 252' is adapted to be further pressed downwardly until the shoulder portion of the operation button 252' is pressed against the driving end of the pusher arm 251' downwardly for blocking up the flow of gas passing through the gas directing conduit 242', so as to provide the torch flame only, as shown in FIG. 5.

Figure 6:
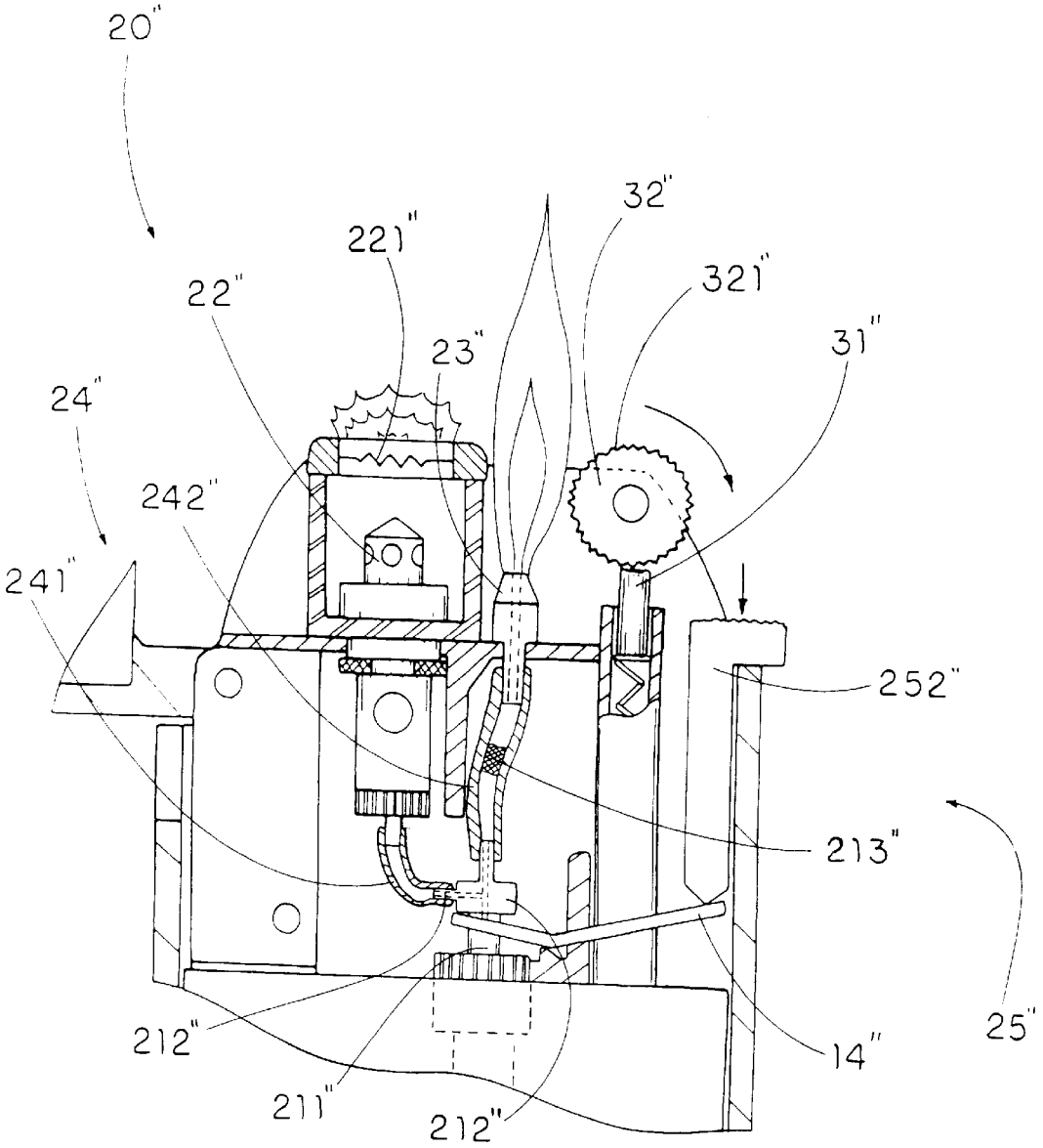
FIG. 6 is a sectional view of a windproof lighter with the flint-type ignition system according to a second preferred embodiment of the present invention, illustrating the windproof lighter being ignited to provide a windproof torch flame.

As shown in FIG. 6, a second embodiment of the windproof lighter illustrates an alternative mode of the first embodiment of the present invention, wherein the windproof torch flame produced by the torch nozzle 22" is arranged to re-ignite the visible flame produced by the gas nozzle 23", so as to provide a windproof visible flame.

According to the second embodiment, the gas directing arrangement 20" further comprises a gas filter 213", having a plurality of meshes, received in the gas directing conduit 242" to partially block the flow of gas passing through the gas directing conduit 242". In other words, the flow of gas passing through the gas directing conduit 242" is about the same of the flow of the gas passing through the torch directing conduit 241".

When the striker wheel 32" is rotated to strike against the flint 31" for producing sparks toward the gas nozzle 23", the flow of gas released from the gas releasable valve 21" through the gas nozzle 23" is ignited by the sparks to provide the visible flame. At the mean time, the visible flame will ignite the flow of gas released from the torch nozzle 22" to provide the windproof torch flame. Due to the windproof feature of the torch nozzle 22", the re-ignition element 221" is adapted to re-ignite the flow of gas passing through the torch nozzle 22". Therefore, the windproof torch flame is arranged to re-ignite the visible frame once the visible flame is blown out. Especially when using the lighter of the present invention to ignite the cigar, the visible flame is preferably used rather than the windproof torch flame since the windproof torch flame may destroy the taste of the cigar. However, the visible flame produced by a convention lighter is too weak that the visible flame is easy to be blown out by the wind. Therefore, the windproof torch flame produced by the torch nozzle 22" functions as an ignition arrangement to maintain the visible flame from the gas nozzle 23".

Figure 7:
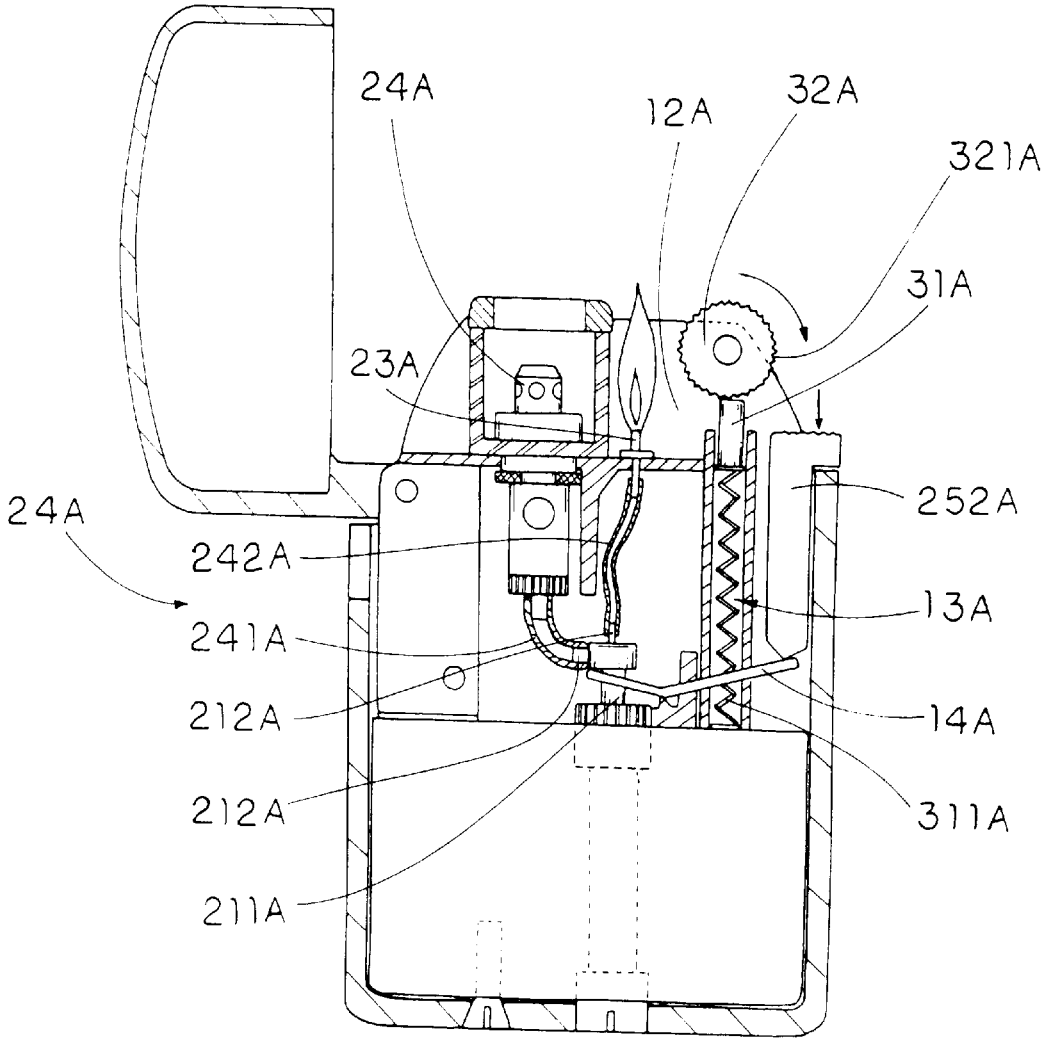
FIG. 7 is a sectional view of a windproof lighter with a flint-type ignition system according to a third preferred embodiment of the present invention, illustrating the gas flame functioning as a flame igniter to ignite the torch flame.

Referring to FIG. 7 of the drawings, a third embodiment of the present invention is illustrated, which is similar to the above first embodiment except that an alternative mode of gas directing arrangement 20A is disclosed, wherein the gas flame functions as a flame igniter to ignite the torch flame.

According to the second embodiment, the gas nozzle 23A is extended to a position below the torch nozzle 22A wherein the flow of gas released from the gas nozzle 23A is ignited by the sparks produced by the ignition system 30A to provide a visible flame having a relatively small intensity adapted to ignite the flow of gas released from the torch nozzle 22A to provide a torch flame.

As shown in FIG. 7, since the purpose of the visible flame, which functions as a flame igniter, is to ignite the gas from the torch nozzle 22A, the amount of the flow of gas through the gas directing conduit 242A should be lesser than the amount of the flow of gas through the torch directing conduit 241A. An inner diameter of the gas directing conduit 242A is smaller that an inner diameter of the torch directing conduit 241A, so that the flow of gas released from the gas releasable valve 21A is split into a larger portion passing toward the torch nozzle 22A through the torch directing conduit 241A and a smaller portion passing toward the gas nozzle 23A through the gas directing conduit 242A. Therefore, the torch flame will be stronger with more gas supply and the visible flame will be strong enough to ignite the gas from the torch nozzle 22A.

It is obvious that the gas releasable valve 21A is adapted to be constructed that the one of the gas outlets 212A allows a larger flow of gas passing to the torch directing conduit 241A from the liquefied gas storage 111A while another gas outlet 212A allow a smaller flow of gas passing to gas directing conduit 242A from the liquefied gas storage 111A in order to achieve the stronger torch flame and the weaker visible flame as mentioned above.

Figure 8:
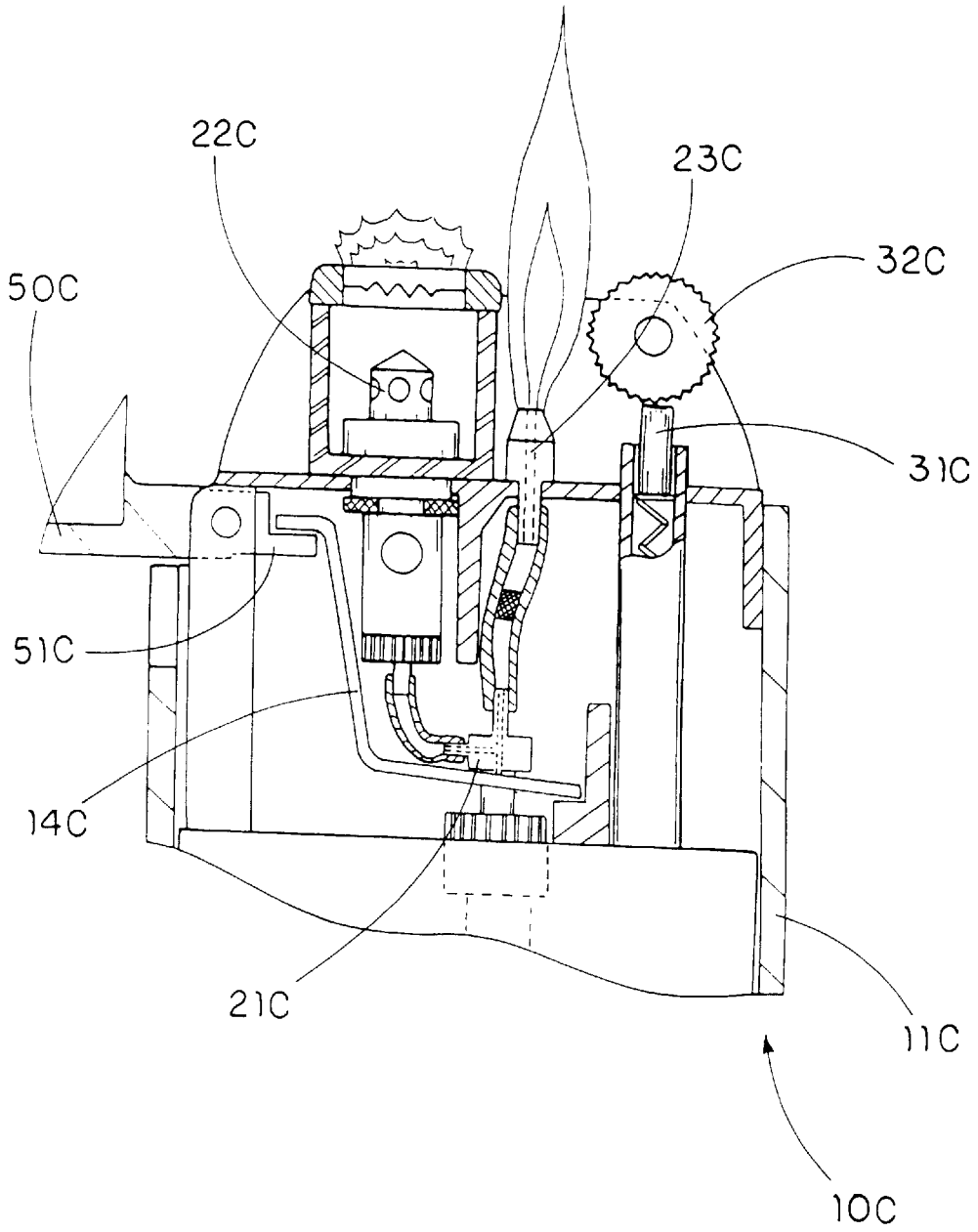
FIG. 8 is a partially section view of a windproof lighter with a flint-type ignition system according to a fourth preferred embodiment of the present invention, illustrating the windproof lighter being ignited to provide both the visible flame and the torch flame at the same time.

As shown in FIG. 8, a windproof lighter of a fourth embodiment illustrates another alternative mode of the third embodiment of the present invention, wherein the windproof lighter is ignited by directly striking the striker wheel 32C against the flint 31C to ignite both the visible flame and the torch flame.

As shown in FIG. 8, the windproof lighter further comprises a lighter cover 50C pivotally mounted on the casing 11C of the supporting frame 10C by means of a pivot arm 51C wherein an inner end of the pivot arm 51C is engaged with the one end of the lever arm 14C in such a manner that when the lighter cover 50C is pivotally and radially folded with respect to the supporting frame 10C, the pivot arm 51C pivotally lifts up the releasable gas valve 21C by the lever arm 14C for releasing gas. At the same time, by rotating the striker wheel 32C against the flint 31C for producing the sparks, the gas emitted from the gas nozzle 23C is ignited to provide a visible flame, so as to ignite the gas emitted from the torch nozzle 22C to provide a windproof torch flame simultaneously. In other words, the windproof lighter of the fourth embodiment does not require any actuation button for the ignition operation.

It is worth to mention that the torch nozzle, according to the preferred embodiments and their alternatives, is adapted to be constructed to produce two or more strong diverging torch flames via a single fuel supplying source, so as to virtually produce a strong and stable gathering group of soaring torches, that is especially good at igniting cigars. Moreover, the re-ignite element is adapted to be installed into the torch nozzle for further enhancing the windproof feature of the present invention.

What is claimed is:

1. A windproof lighter, comprising:

a supporting frame comprising a casing having a liquefied gas storage and a lever arm, having a lifting end and a depressible end, pivotally supported in said casing;

a gas directing arrangement, comprising:

a gas releasable valve extended from the liquefied gas storage for controlling a flow of gas from the liquefied gas storage wherein said lifting end of said lever arm is engaged with said gas releasable valve in such a manner that when said depressible end of said lever arm is depressed downwardly, said lifting end of said lever arm lifts up said gas releasable valve for releasing said flow of gas from said liquefied gas storage;

a torch nozzle receiving in a nozzle housing and appearing from a ceiling of said casing;

a gas nozzle positioned adjacent to said torch nozzle at a position at least 2 mm below a ceiling of said nozzle housing of said torch nozzle;

a gas directing unit comprising a torch directing conduit extended from said gas releasable valve to said torch nozzle for directing said flow of gas toward said torch nozzle and a gas directing conduit extended from said gas releasable valve to said gas nozzle for directing said flow of gas toward said gas nozzle; and a gas detouring unit mounted to said casing in a movable manner; and an ignition system installed into said supporting frame for producing sparks towards said gas nozzle to ignite said flow of gas emitted from said gas nozzle for providing a visible flame so as to ignite said flow of gas emitted from said torch nozzle for producing a torch flame, wherein said gas detouring unit is adapted to move to a position to block said flow of gas passing through said gas directing conduit while said torch directing conduit is remained open in such a manner that said flow of gas passing from gas releasable valve is selectively detoured to said gas nozzle for producing said visible flame and to said torch nozzle for producing said torch flame.

2. The windproof lighter, as recited in claim 1, wherein said gas detouring unit comprises a pusher arm movably supported in said casing and an operation button extended from said casing to outside wherein said pusher arm is arranged to be driven by said operation button to bias against said gas directing conduit so as to block up said flow of gas passing therethrough while said torch directing conduit is remained open to allow said gas passing through said torch directing conduit for producing said torch flame.

3. The windproof lighter, as recited in claim 2, wherein said operation button is integrally extended from said pusher arm and arranged to push said pusher arm inwardly to bias against said gas directing conduit, wherein a bottom end of said operation button is extended to bias against said depressible end of said lever end so as to depress said depressible end of said lever end for releasing gas when said operation button is moved downwardly.

4. The windproof lighter, as recited in claim 2, wherein said operation button, which is disposed in said casing in a vertical movable manner, has a bottom end extended to bias against said depressible end of said lever arm to drive said depressible end downwardly for releasing gas, a control portion extended from said casing to outside for driving said bottom end downwardly, and a shoulder portion provided between said control portion and said bottom end, wherein said pusher arm which is pivotally supported in said casing has a pushing end and a driving end arranged to be downwardly driven by said shoulder portion of said operation button by further depressing said operation button, so to pivotally lift up said pushing end to press against said gas directing conduit for blocking up said flow of gas passing through said gas directing conduit.

5. The windproof lighter, as recited in claim 1, wherein said ignition system comprises a flint supported by said supporting frame and a striker wheel having a circumferential coarse striking surface positioned in contact with said flint, wherein said flint is retained urging against said striking surface of said striker wheel for producing sparks directed toward said gas nozzle when said striking surface is driven to strike against said flint, such that said flow of gas emitted from said gas nozzle is ignited to provide said visible flame, so as to ignite said flow of gas emitted from said torch nozzle to provide said torch flame.

6. The windproof lighter, as recited in claim 3, wherein said ignition system comprises a flint supported by said supporting frame and a striker wheel having a circumferential coarse striking surface positioned in contact with said flint, wherein said flint is retained urging against said striking surface of said striker wheel for producing sparks directed toward said gas nozzle when said striking surface is driven to strike against said flint, such that said flow of gas emitted from said gas nozzle is ignited to provide a visible flame, so as to ignite said flow of gas emitted from said torch nozzle to provide a torch flame.

7. The windproof lighter, as recited in claim 4, wherein said ignition system comprises a flint supported by said supporting frame and a striker wheel having a circumferential coarse striking surface positioned in contact with said flint, wherein said flint is retained urging against said striking surface of said striker wheel for producing sparks directed toward said gas nozzle when said striking surface is driven to strike against said flint, such that said flow of gas emitted from said gas nozzle is ignited to provide a visible flame, so as to ignite said flow of gas emitted from said torch nozzle to provide a torch flame.

8. The windproof lighter, as recited in claim 5, wherein said supporting frame further has a pair of supporting walls protruded on opposite sides of said ceiling of said casing and an ignition cavity provided between said two supporting walls such that said striker wheel is rotatably received in said ignition cavity, wherein said torch nozzle is surrounded by said nozzle housing within said ignition cavity so as to prevent residues of said flint entering into said torch nozzle when said striker wheel is rotated to strike against said flint.

9. The windproof lighter, as recited in claim 6, wherein said supporting frame further has a pair of supporting walls protruded on opposite sides of said ceiling of said casing and an ignition cavity provided between said two supporting walls such that said striker wheel is rotatably received in said ignition cavity, wherein said torch nozzle is surrounded by said nozzle housing within said ignition cavity so as to prevent residues of said flint entering into said torch nozzle when said striker wheel is rotated to strike against said flint.

10. The windproof lighter, as recited in claim 7, wherein said supporting frame further has a pair of supporting walls protruded on opposite sides of said ceiling of said casing and an ignition cavity provided between said two supporting walls such that said striker wheel is rotatably received in said ignition cavity, wherein said torch nozzle is surrounded by said nozzle housing within said ignition cavity so as to prevent residues of said flint entering into said torch nozzle when said striker wheel is rotated to strike against said flint.

11. A windproof lighter, comprising:

a supporting frame comprising a casing having a liquefied gas storage and a lever arm, having a lifting end and a depressible end, pivotally supported in said casing;

a gas directing arrangement, comprising:

a gas releasable valve extended from said liquefied gas storage for controlling a flow of gas from said liquefied gas storage wherein said lifting end of said lever arm is engaged with said gas releasable vale in such a manner that when said depressible end of said lever arm is depressed downwardly, said lifting end of said lever arm lifts up said gas releasable valve for releasing said flow of gas from said liquefied gas storage;

a torch nozzle receiving in a nozzle housing and appearing from a ceiling of said casing;

a gas nozzle positioned adjacent to said torch nozzle at a position at least 2 mm below a ceiling of said nozzle housing of said torch nozzle;

a gas directing unit comprising a torch directing conduit extended from said gas releasable valve to said torch nozzle for directing said flow of gas toward said torch nozzle and a gas directing conduit extended from said gas releasable valve to said gas nozzle for directing said flow of gas toward said gas nozzle; and a gas detouring unit mounted to said casing in a movable manner and arranged to move to a position to block said flow of gas passing through said gas directing conduit while said torch directing conduit is remained open; and an ignition system, installed into said supporting frame for producing sparks towards said gas nozzle to ignite said flow of gas emitted from said gas nozzle for providing a visible flame to ignite said flow of gas emitted from said torch nozzle for providing a windproof torch flame, wherein said windproof torch flame is arranged to re-ignite said visible flame when said visible flame is blown out.

12. The windproof lighter, as recited in claim 11, wherein said ignition system comprises a flint supported by said supporting frame and a striker wheel having a circumferential coarse striking surface positioned in contact with said flint, wherein said flint is retained urging against said striking surface of said striker wheel for producing sparks directed toward said gas nozzle when said striking surface is driven to strike against said flint, such that said flow of gas emitted from said gas nozzle is ignited to provide said visible flame, so as to ignite said flow of gas emitted from said torch nozzle to provide said windproof torch flame.

13. The windproof lighter, as recited in claim 12, wherein said supporting frame further has a pair of supporting walls protruded on opposite sides of said ceiling of said casing and an ignition cavity provided between said two supporting walls such that said striker wheel is rotatably received in said ignition cavity, wherein said torch nozzle is surrounded by said nozzle housing within said ignition cavity so as to prevent residues of said flint entering into said torch nozzle when said striker wheel is rotated to strike against said flint.

14. The windproof lighter, as recited in claim 11, wherein said gas directing arrangement further comprises a gas filter, having a plurality of meshes, received in said gas directing conduit to partially block said flow of gas passing through said gas directing conduit.

15. The windproof lighter, as recited in claim 12, wherein said gas directing arrangement further comprises a gas filter, having a plurality of meshes, received in said gas directing conduit to partially block said flow of gas passing through said gas directing conduit.

16. The windproof lighter, as recited in claim 13, wherein said gas directing arrangement further comprises a gas filter, having a plurality of meshes, received in said gas directing conduit to partially block said flow of gas passing through said gas directing conduit.

17. A windproof lighter, comprising:

a supporting frame comprising a casing having a liquefied gas storage;

a gas directing arrangement, comprising a gas releasable valve extended from the liquefied gas storage, a torch nozzle receiving in a nozzle housing and appearing from a ceiling of said casing, a gas nozzle positioned adjacent to said torch nozzle at a position at least 2 mm below a ceiling of said nozzle housing of said torch nozzle, and a gas directing unit comprising a torch directing conduit extended from said gas releasable valve to said torch nozzle for directing said flow of gas toward said torch nozzle and a gas directing conduit extended from said gas releasable valve to said gas nozzle for directing said flow of gas toward said gas nozzle; and an ignition system, comprising:

a flint supported by said supporting frame, and a striker wheel having a circumferential coarse striking surface positioned in contact with said flint, wherein said flint is retained urging against said striking surface of said striker wheel for producing sparks directed toward said gas nozzle when said striking surface is driven to strike against said flint, such that said flow of gas emitted from said gas nozzle is ignited to provide a visible flame which functions as a flame igniter, so as to ignite said flow of gas emitted from said torch nozzle to provide a torch flame.

18. The windproof lighter, as recited in claim 17, wherein said gas directing conduit has an inner diameter smaller than an inner diameter of said torch directing conduit in such a manner that said flow of gas released from said gas releasable valve is split into a larger portion passing through said torch directing conduit to said torch nozzle and a smaller portion passing through said gas directing conduit to said gas nozzle.

19. The windproof lighter, as recited in claim 17, wherein said supporting frame further has a pair of supporting walls protruded on opposite sides of said ceiling of said casing and an ignition cavity provided between said two supporting walls such that said striker wheel is rotatably received in said ignition cavity, wherein said torch nozzle is surrounded by said nozzle housing within said ignition cavity so as to prevent residues of said flint entering into said torch nozzle when said striker wheel is rotated to strike against said flint.

20. The windproof lighter, as recited in claim 18, wherein said supporting frame further has a pair of supporting walls protruded on opposite sides of said ceiling of said casing and an ignition cavity provided between said two supporting walls such that said striker wheel is rotatably received in said ignition cavity, wherein said torch nozzle is surrounded by said nozzle housing within said ignition cavity so as to prevent residues of said flint entering into said torch nozzle when said striker wheel is rotated to strike against said flint.

* * * * *